US007644900B2

(12) United States Patent
Yap et al.

(10) Patent No.: US 7,644,900 B2
(45) Date of Patent: Jan. 12, 2010

(54) PORTABLE HANGER FOR PURSE

(75) Inventors: Kalika N. Yap, Santa Monica, CA (US); Catherine A. Mangan, Dupont, PA (US)

(73) Assignee: Luxe Link, LLC, Santa Monica, CA (US)

( * ) Notice: Subject to any disclaimer, the term of this patent is extended or adjusted under 35 U.S.C. 154(b) by 122 days.

(21) Appl. No.: 11/504,328

(22) Filed: Aug. 15, 2006

(65) Prior Publication Data

US 2008/0042032 A1 Feb. 21, 2008

(51) Int. Cl.
*F16B 45/00* (2006.01)

(52) U.S. Cl. ..... 248/304; 248/308; 248/215; 248/914; 223/120

(58) Field of Classification Search ..... 248/215, 248/206.5, 304, 308, 324, 339, 914, 687, 248/690, 691, 692, 693; 223/120
See application file for complete search history.

(56) References Cited

U.S. PATENT DOCUMENTS

| | | | | | |
|---|---|---|---|---|---|
| 1,819,768 | A | | 8/1931 | Coffing | |
| 2,473,086 | A | * | 6/1949 | Montero | 248/308 |
| 2,490,405 | A | | 12/1949 | Bloom et al. | |
| 2,521,037 | A | * | 9/1950 | Brinton | 211/85.3 |
| 2,532,255 | A | * | 11/1950 | Davis | 248/215 |
| 2,631,803 | A | * | 3/1953 | Meyers | 248/215 |
| 2,692,108 | A | * | 10/1954 | Neivert | 248/215 |
| 3,289,985 | A | * | 12/1966 | Sheiman | 248/95 |
| 3,321,166 | A | * | 5/1967 | Gordon | 248/205.5 |
| 3,465,543 | A | * | 9/1969 | Baker | 63/15.5 |
| D229,870 | S | | 1/1974 | Czarny | |
| 3,860,210 | A | * | 1/1975 | Berardinelli et al. | 248/308 |
| 4,118,001 | A | * | 10/1978 | Serkez | 248/308 |
| 5,094,417 | A | | 3/1992 | Creed | |
| D384,505 | S | | 10/1997 | Stewart | |
| 5,895,018 | A | * | 4/1999 | Rielo | 248/206.5 |
| 5,926,925 | A | * | 7/1999 | Hicks | 24/303 |
| D429,899 | S | | 8/2000 | Schwartz | |
| 7,516,929 | B2 | * | 4/2009 | Brustein et al. | 248/304 |
| 2005/0082319 | A1 | * | 4/2005 | Caroselli et al. | 223/120 |
| 2005/0161570 | A1 | * | 7/2005 | Bauerly | 248/317 |
| 2006/0108497 | A1 | * | 5/2006 | Miranda | 248/690 |

OTHER PUBLICATIONS

Dangle-it, Author Unkown, http://dangle-it.com/index.html, Aug. 16, 2006.
PursePal, Author Unkown, http://purse-pal.com, Aug. 16, 2006.

* cited by examiner

*Primary Examiner*—Anita M King
(74) *Attorney, Agent, or Firm*—Roeder & Broder LLP; James P. Broder

(57) ABSTRACT

A portable hanger for hanging a purse from a table has a base adapted to rest upon and frictionally engage the table. A plurality of links are pivotally linked to each other in series to form a chain having a first link and a last link. A pivot pin pivotally connects the base and the first link of the plurality of links. The plurality of links are adapted for pivot between a stored configuration in which the plurality of links are positioned generally adjacent the perimeter of the base, and an operative configuration in which the plurality of links form a hook adapted for hanging the purse.

23 Claims, 3 Drawing Sheets

PORTABLE HANGER FOR PURSE

CROSS-REFERENCE TO RELATED APPLICATIONS

Not Applicable

STATEMENT REGARDING FEDERALLY SPONSORED RESEARCH

Not Applicable

BACKGROUND OF THE INVENTION

1. Field of the Invention

This invention relates generally to hanging accessories, and more particularly to a portable hanger for hanging a purse from a table.

2. Description of Related Art

The prior art teaches various forms of hangers for hanging a purse. For example, Czarny, U.S. Pat. No. D229,870, teaches a portable hanger for hanging a lady's purse beneath a table. The hanger includes a base with a planar lower surface, and a rigid hanger element that extends from the side of the base and extends downwardly to a hook element for hanging the purse.

Alternative embodiments of the portable hanger are taught in Schwartz, U.S. Pat. No. D429,899, and Stewart, U.S. Pat. No. D384,505. These reference teach a purse holder that includes a planar base with a rigid hook-shaped element that is pivotally attached to the base with that the hook can pivot with respect to the base. While the hook can pivot with respect to the base, the hook itself is rigid and cannot be folded.

Creed, U.S. Pat. No. 5,094,417, teaches a handbag adaptable support that includes a base with a rigidly attached first hook element, and a second hook element that is pivotally attached to the first element.

The above-described references are hereby incorporated by reference in full.

The prior art teaches various forms of portable hangers that include a base and a rigid hook, or a hook with a limited pivoting and folding ability. However, the prior art does not teach a portable hanger that includes a plurality of links that can be collapsed from an operative, hook-shaped configuration adapted for hanging the purse, to a stored configuration in which the plurality of links are wrapped around the perimeter of the base. The present invention fulfills these needs and provides further related advantages as described in the following summary.

SUMMARY OF THE INVENTION

The present invention teaches certain benefits in construction and use which give rise to the objectives described below.

The present invention provides a portable hanger for hanging a purse from a table. The portable hanger includes a base having a generally planar bottom surface and a perimeter. The bottom surface is adapted to rest upon and frictionally engage the table. A plurality of links are pivotally linked to each other in series to form a chain having a first link and a last link. A connector pivotally connects the base and the first link of the plurality of links, such that the first link can pivot between a first position and a second position with respect to the base. The plurality of links are adapted for pivot between a stored configuration in which the pivot pin is in the first position and in which the plurality of links are positioned generally adjacent the perimeter of the base, and an operative configuration in which the connector is in the second position and in which the plurality of links form a hook, such that the purse may be hung upon the hook when the base is positioned on the table.

A primary objective of the present invention is to provide a portable hanger having advantages not taught by the prior art.

Another objective is to provide a portable hanger that includes a plurality of links that can be collapsed from an operative, hook-shaped configuration, to a stored configuration in which the plurality of links are wrapped around the perimeter of the base.

Another objective is to provide a portable hanger whose plurality of links can be folded to a ring configuration and removably attached to the base for storing the hanger on a purse as a purse accessory.

A further objective is to provide a portable hanger having a magnetic locking element for locking the plurality of links in the ring configuration.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

The above-described drawing figures illustrate the invention, a portable hanger 10 for hanging an article, such as a purse 12, from a table 14. Of course, the portable hanger 10 is also suitable for supporting other articles, such as coats, hats, umbrellas, shopping bags, etc., and such alternatives should be considered within the scope of the claimed invention.

Figure 1:
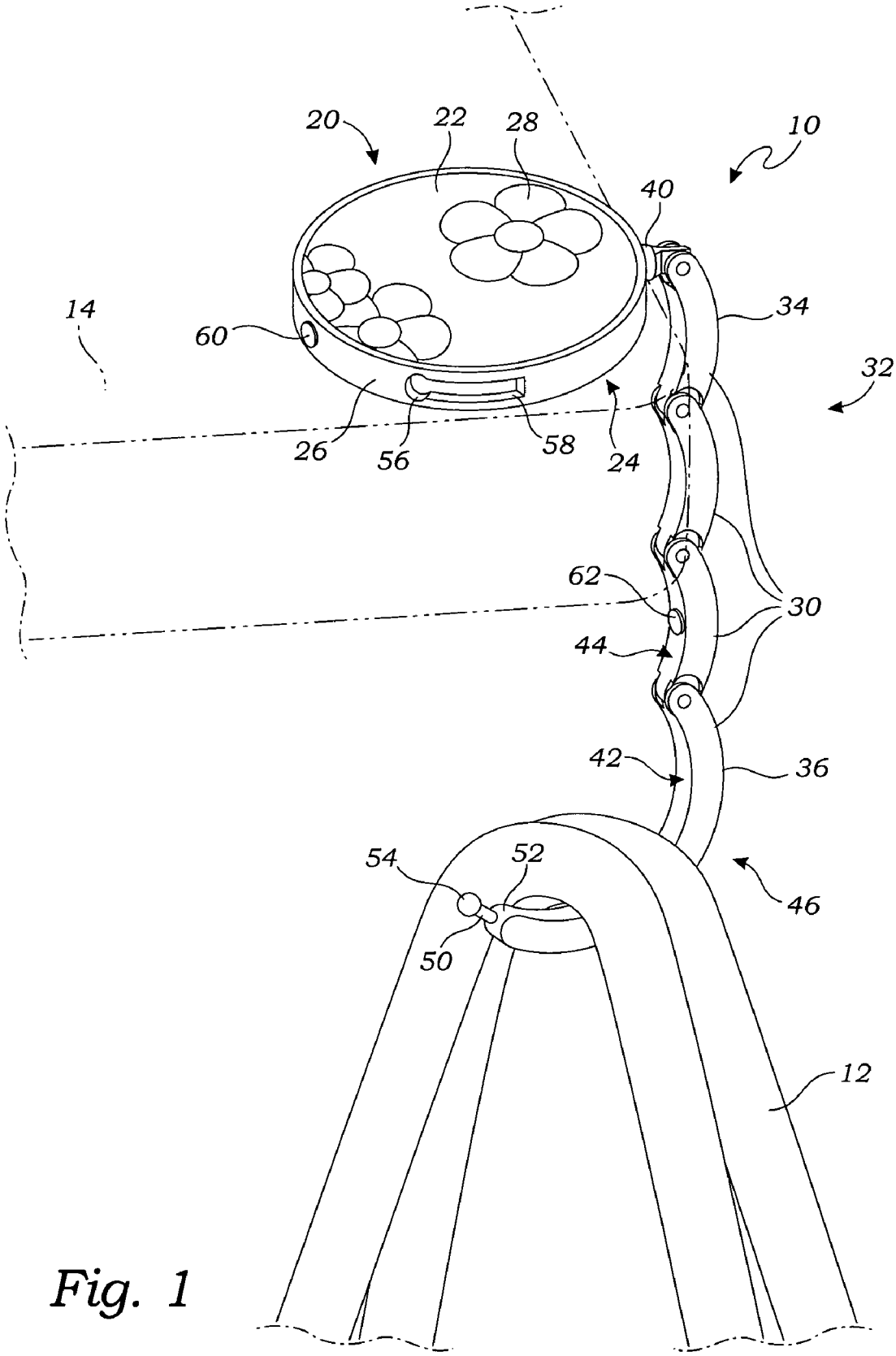
FIG. 1 is a perspective view of a portable hanger according to a preferred embodiment of the present invention, the portable hanger being illustrated in an operative configuration with a base on a table and a plurality of links forming a hook for hanging a purse.

FIG. 1 is a perspective view of the portable hanger 10 according to a preferred embodiment of the present invention, the portable hanger 10 being illustrated in an operative configuration with a base 20 on a table 14 and a plurality of links 30 forming a hook 46 for hanging a purse 12. As shown in FIG. 1, the base 20 includes a top surface 22, a generally planar bottom surface 24 opposite the top surface 22, and a perimeter 26 connecting the top and bottom surfaces 22 and 24. As shown in FIG. 1, the bottom surface 24 (best illustrated in FIG. 3) is adapted to rest upon and frictionally engage the table 14. While we discuss hanging the portable hanger 10 on a table 14, the term table is hereby defined to include any generally planar surface upon which a user might want to hang the purse 12.

In the embodiment of FIG. 1, the base 20 is generally disk-shaped, and the top surface 22 includes a decorate indicia 28. However, the base 20 may be any operative shape and may include a variety of decorative shapes, indicia, and features, and all such alternative shapes and arrangements should be considered within the scope of the present invention. The base 20 may be constructed of any suitable material, including plastic for less expensive embodiments, metal for more expensive embodiments, and potentially even precious metals for the most expensive embodiments.

The portable hanger 10 further includes a plurality of links 30 pivotally linked to each other in series to form a chain 32 having a first link 34 and a last link 36. A connector 40, such as a pivot pin 40, extends from the perimeter 26 of the base 20 and pivotally connects the base 20 and the first link 34 of the plurality of links 30, such that the first link 34 can pivot inwardly between a first position, illustrated in FIG. 1, and a second position, illustrated in FIG. 3, with respect to the base 20. The plurality of links 30 are adapted for pivot between a stored configuration, shown in FIG. 3, in which the pivot pin 40 is in the first position and in which the plurality of links 30 are positioned generally adjacent the perimeter 26 of the base 20, and an operative configuration, shown in FIGS. 1 and 4, in which the pivot pin 40 is in the second position and in which the plurality of links 30 form a support structure 46, such as a hook, such that the purse 12 may be hung upon the hook 46 when the base 20 is positioned on the table 14.

The last link 36 of the plurality of links 30 includes a concave inner surface 42 that functions to frictionally engage the purse 12. In the preferred embodiment, most or all of the plurality of links 30 are curved, or include concave inner surfaces 44, for forming the hook 46. In alternate embodiments, the links 30 might take on other shapes.

In the preferred embodiment, as shown in FIG. 1, the portable hanger 10 further includes a locking means for locking the plurality of links 30 in the stored configuration. In one embodiment, the locking means includes first and second magnets 60 and 62 that magnetically lock the plurality of links 30 in the stored configuration. In one embodiment, the first magnet 60 is mounted on the perimeter 26 of the base 20, and the second magnet 62 is mounted on one of the plurality of links 30, such as the concave inner surface 44 of one of the links 30. While one embodiment is illustrated, other embodiments should also be considered within the scope of the present invention. For example, multiple magnets could be used in various operative locations. Furthermore, while magnets are currently preferred, other forms of snaps, clips, friction-locks, or other features or locking mechanisms could be used, and such alternatives should be considered within the scope of the locking means.

Figure 2:
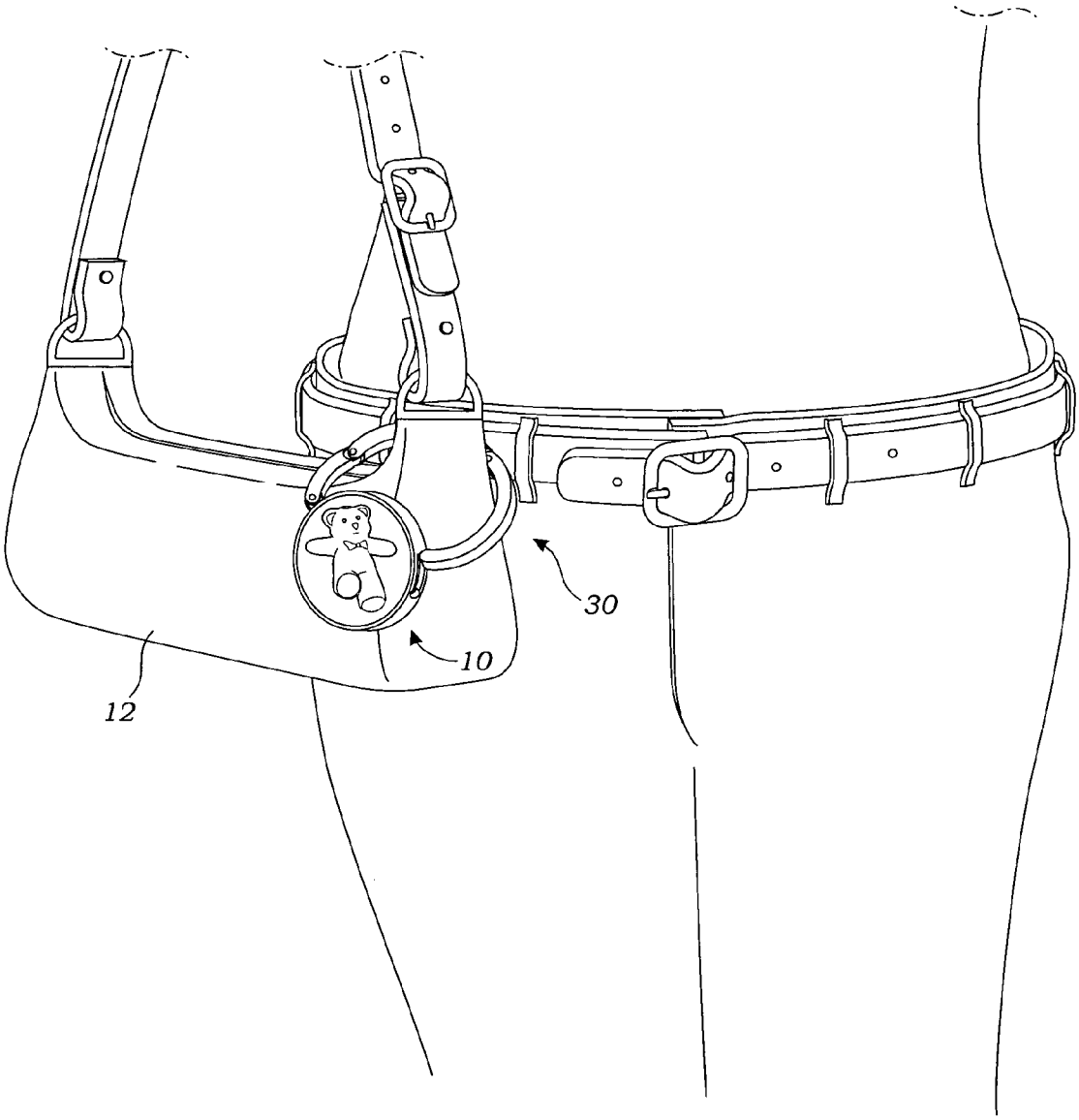
FIG. 2 is a perspective view of the portable hanger in a ring configuration being carried on a purse.
Figure 4:
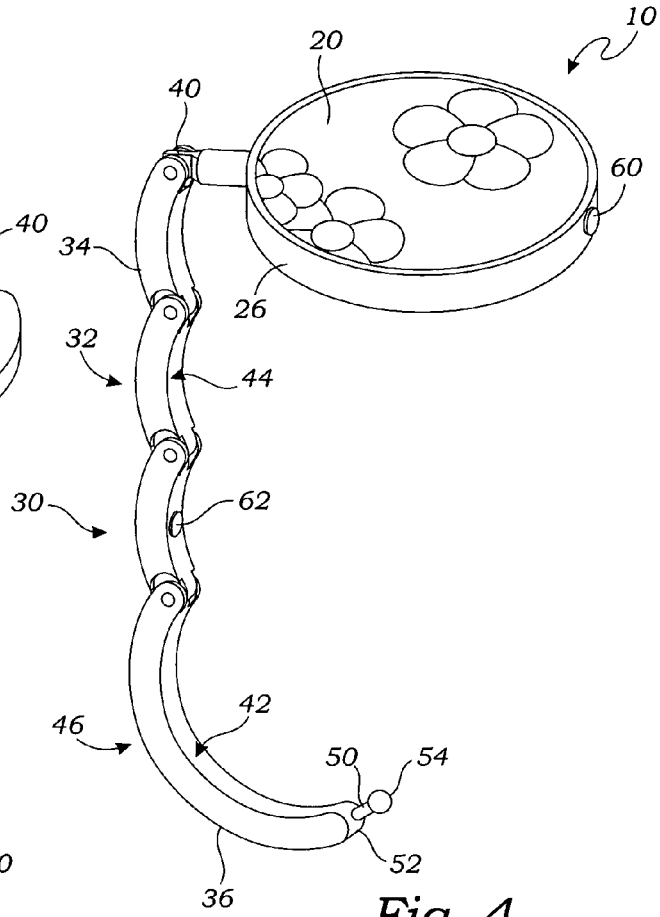
FIG. 4 is a perspective view of the portable hanger in the operative configuration.
Figure 5:
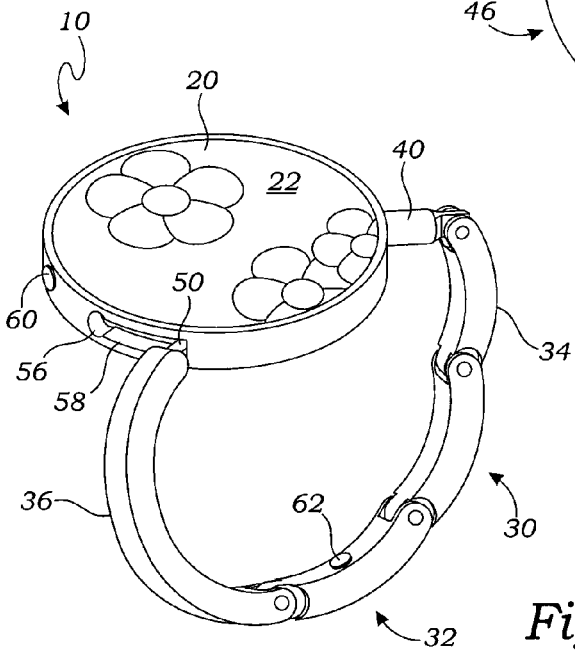
FIG. 5 is a perspective view of the portable hanger in the ring configuration.

FIG. 2 is a perspective view of the portable hanger 10 in a ring configuration being carried on a purse 12. As shown in FIGS. 4 and 5, the portable hanger 10 preferably includes means for interlocking the last link 36 with the base 20. The means for interlocking preferably includes a pin 50 extending from a terminal end 52 of the last link 36. The pin 50 preferably extends to a ball-end 54. For purposes of this application, the terms pin 50 and ball-end 54 are hereby defined to include any shaped elements that function as described below. A ball-receiver 56 in the base 20, preferably in the perimeter 26 of the base 20, includes a slot 58 shaped to receive the pin 50 and lockingly engage the ball-end 54, such that the last link 36 may be removably engaged with the base 20 and such that the base 20 and the plurality of links 30 together form a loop, and such that the portable hanger 10 is maintained in a ring configuration.

In the ring configuration, as shown in FIG. 2, the portable hanger 10 may be carried on the purse 12 as a decorative accessory. Other interlocking structures could also be employed without departing from the disclosed invention, and should be considered within the scope of the present invention. The means for interlocking may alternatively include, for example, various forms of snaps, locking elements, or other structures known in the art.

Figure 3:
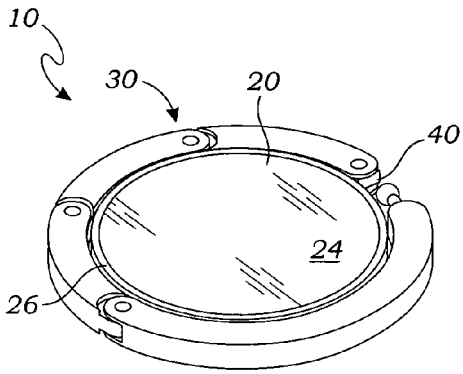
FIG. 3 is a bottom perspective view of the portable hanger in a stored configuration.

FIG. 3 is a bottom perspective view of the portable hanger 10 in the stored configuration. The bottom surface 24 of the base 20 is adapted to frictionally engage the table 13. The bottom surface 24 may include a non-skid coating (not shown) such as rubber, or a textured surface, for enhancing the frictional engagement between the bottom surface 24 and the table 14.

FIG. 4 is a perspective view of the portable hanger in the operative configuration.

FIG. 5 is a perspective view of the portable hanger in the ring configuration.

The terminology used in the preceding description includes the words described above, similar or equivalent words, and derivatives thereof. Additionally, the words "a," "an," and "one" are defined to include one or more of the referenced item unless specifically stated otherwise. Also, the terms "have," "include," "contain," and similar terms are defined to mean "comprising" unless specifically stated otherwise.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A portable hanger for hanging an article relative to a surface, the portable hanger comprising:

a base having a generally planar bottom surface and a perimeter, the bottom surface being adapted to rest upon and frictionally engage the surface;

a plurality of links pivotally linked to each other in series to form a chain having a first link and a last link;

a pivot pin that pivotally connects the base and the first link of the plurality of links, such that the first link can pivot between a first position and a second position with respect to the base; and a means for interlocking the last link with the base, wherein a portion of the last link extends into the base;

wherein the plurality of links are adapted for pivot between a stored configuration in which the first link is in the first position and in which the plurality of links are positioned generally adjacent the perimeter of the base, and an operative configuration in which the first link is in the second position and in which the plurality of links form a hook, such that the article may be hung upon the hook when the base is positioned on the surface.

2. The portable hanger of claim 1, wherein the means for interlocking comprises:

a pin extending from a terminal end of the last link, the pin extending to a ball-end; and a ball-receiver in the perimeter of the base, the ball-receiver having a slot shaped to receive the pin and lockingly engage the ball-end, such that the last link may be removably engaged with the base and such that the base and the plurality of links together form a loop.

3. The portable hanger of claim 1, wherein the base is generally disk-shaped.

4. The portable hanger of claim 1, wherein the base includes a top surface opposite the bottom surface, and a decorative indicia positioned on the top surface.

5. The portable hanger of claim 1, wherein the last link of the plurality of links includes a concave inner surface that is adapted to engage the article.

6. The portable hanger of claim 1 wherein the portion of the last link extends into the perimeter of the base.

7. The portable hanger of claim 1 further comprising a locking means that secures the plurality of links in the stored configuration.

8. The portable hanger of claim 7 wherein the locking means includes a magnet.

9. A hanger for hanging an object, the hanger comprising:

a base having a substantially planar bottom surface and a perimeter;

a plurality of links including a first link and a last link, the plurality of links being adapted to form a ring configuration so that the first and last link are selectively attached to the base, each link having a corresponding inner surface; and a connector that connects the first link to the base so that the plurality of links can move between (i) an operative configuration in which the last link provides a support structure for hanging the object, and (ii) a stored configuration wherein the inner surfaces of the links abut the perimeter of the base.

10. The hanger of claim 9 wherein the support structure is a hook.

11. The hanger of claim 9 further comprising a locking means that selectively secures the plurality of links in the stored configuration.

12. The portable hanger of claim 11, wherein the locking means includes a magnet.

13. The hanger of claim 9 wherein in the ring configuration, the last link at least partially extends into the perimeter of the base.

14. A hanger for hanging an article relative to a surface, the hanger comprising:

a base having a generally planar bottom surface and a perimeter, the bottom surface being adapted to rest upon the surface; and a plurality of links that form a chain having a first link and a last link, the first link being movably connected to the perimeter of the base, the last link being adapted to interlock with the base;

a pin that extends from a terminal end of the last link, the pin including a ball-end; and a ball-receiver along the perimeter of the base, the ball-receiver having a slot shaped to receive the pin and lockingly engage the ball-end;

wherein the chain is adapted to move between a stored configuration in which the chain contacts the perimeter of the base, and an operative configuration in which the chain forms a hook that is adapted to suspend the article when the base is positioned on the surface.

15. A hanger for hanging an article relative to a surface, the hanger comprising:

a base having a bottom surface and a perimeter, the bottom surface being adapted to contact the surface;

a plurality of links that form a chain having a first link and a last link, the first link being movably connected to the perimeter of the base, the chain being movable between (i) an operative configuration in which the chain forms a support structure that is adapted to suspend the article when the bottom surface of the base is in contact with the surface, and (ii) a stored configuration in which at least a portion of the chain is positioned generally adjacent the perimeter of the base; and a locking means that selectively secures at least the portion of the chain against the perimeter of the base in the stored configuration, the locking means including a magnet.

16. The portable hanger of claim 15, wherein the locking means includes first and second magnets.

17. The portable hanger of claim 16, wherein the first magnet is mounted on the perimeter of the base, and the second magnet is mounted on one of the plurality of links.

18. A hanger for hanging an article relative to a surface, the hanger comprising:

a base having a bottom surface and a perimeter, the bottom surface being adapted to contact the surface;

a plurality of links that form a chain having a first link and a last link, the first link being movably connected to the perimeter of the base, the chain being movable between (i) an operative configuration in which the chain forms a support structure that is adapted to suspend the article when the bottom surface of the base is in contact with the surface, and (ii) a stored configuration in which at least a portion of the chain is positioned generally adjacent the perimeter of the base; and a locking means that selectively secures at least the portion of the chain against the perimeter of the base in the stored configuration, the locking means including a first magnet and a second magnet.

19. The hanger of claim 18 wherein the last link is adapted to interlock with the perimeter of the base.

20. A portable hanger for hanging an article relative to a surface, the portable hanger comprising:

a base having a generally planar bottom surface and a perimeter, the bottom surface being adapted to rest upon and frictionally engage the surface;

a plurality of links pivotally linked to each other in series to form a chain having a first link and a last link;

a pivot pin that pivotally connects the perimeter of the base and the first link so that the first link can pivot between a first position and a second position with respect to the base;

wherein the plurality of links are adapted for pivot between a stored configuration in which the first link is in the first position and in which the plurality of links contact the perimeter of the base, and an operative configuration in which the first link is in the second position and in which the plurality of links form a hook so that the article may be hung upon the hook when the base is positioned on the surface; and a locking means for securing the plurality of links in the stored configuration, the locking means including first and second magnets.

21. The hanger of claim 20, wherein the first magnet is mounted on the perimeter of the base, and the second magnet is mounted on one of the plurality of links.

22. A hanger for hanging an article relative to a surface, the hanger comprising:

a base having a generally planar bottom surface and a perimeter, the bottom surface being adapted to rest upon the surface;

a plurality of links that form a chain having a first link and a last link, the first link being movably connected to the perimeter of the base, the last link being adapted to interlock with the base; and a locking means that selectively secures the chain in the stored configuration, the locking means including a magnet;

wherein the chain is adapted to move between a stored configuration in which the chain contacts the perimeter of the base, and an operative configuration in which the chain forms a hook that is adapted to suspend the article when the base is positioned on the surface.

23. The hanger of claim 22 further comprising a connector that connects the first link to the base so that the plurality of links can move between the operative configuration and the stored configuration.

* * * * *